US007490427B2

(12) United States Patent
Dahlquist

(10) Patent No.: US 7,490,427 B2
(45) Date of Patent: Feb. 17, 2009

(54) DISPLAY EASEL, DEVICE AND METHOD

(75) Inventor: Ake L. Dahlquist, Dixon, IL (US)

(73) Assignee: Sleepeck Printing Company, Dixon, IL (US)

( * ) Notice: Subject to any disclaimer, the term of this patent is extended or adjusted under 35 U.S.C. 154(b) by 491 days.

(21) Appl. No.: 10/861,555

(22) Filed: Jun. 4, 2004

(65) Prior Publication Data

US 2005/0268511 A1 Dec. 8, 2005

(51) Int. Cl.
*A47G 1/16* (2006.01)
*A47B 97/04* (2006.01)

(52) U.S. Cl. ..... 40/755; 248/463

(58) Field of Classification Search ..... 40/753–755, 40/750, 786, 788, 124.17–124.18; 248/463–465, 248/459, 460; D6/310–312
See application file for complete search history.

(56) References Cited

U.S. PATENT DOCUMENTS 1,146,103 A * 7/1915 Roy ..... 248/459
1,232,766 A 7/1917 Cadmus
1,448,549 A * 3/1923 Wilkinson ..... 248/450
1,710,814 A * 4/1929 Dyment ..... 248/459
2,115,293 A * 4/1938 Wood ..... 40/124.18
2,120,472 A * 6/1938 Rosenak ..... 40/124.17
2,204,881 A * 6/1940 Belleisle ..... 248/459
2,270,763 A * 1/1942 Nofziger ..... 40/124.18
2,443,645 A * 6/1948 Turan ..... 40/750
3,191,327 A * 6/1965 Neff ..... 40/124.17
3,990,578 A 11/1976 Roeser
4,509,712 A 4/1985 Moller
4,622,767 A 11/1986 Sullivan
4,963,125 A 10/1990 Volkert
5,078,670 A 1/1992 Vokert
5,123,890 A 6/1992 Green, Jr.
5,181,901 A 1/1993 Volkert
5,346,455 A 9/1994 Volkert
5,492,522 A 2/1996 Rubar
D384,278 S 9/1997 Bosworth
5,769,773 A 6/1998 De Santo
5,871,828 A 2/1999 Volkert
6,068,903 A 5/2000 Volkert
6,581,895 B1 6/2003 Pleasant
2002/0129530 A1 * 9/2002 Delozada et al. ..... 40/788
2004/0003520 A1 1/2004 Trew

* cited by examiner

*Primary Examiner*—Cassandra Davis
(74) *Attorney, Agent, or Firm*—Ryndak & Suri LLP

(57) ABSTRACT

A display easel is provided having a base or first panel which includes a horizontal supporting tab and a vertical restraining tab spaced in vertical relation to the supporting tab. The horizontal supporting tab has a first hinge that enables movement of the supporting tab relative to the panel body, preferably to about 90 degrees, into a position for supporting the first panel. The vertical restraining tab has a second hinge which enables movement of the vertical restraining tab relative to the panel body, preferably between about 120 degrees and 160 degrees, to permit abutment of the vertical restraining tab to the horizontal supporting tab and to restrain movement of the horizontal supporting tab. By restraining movement of the horizontal supporting tab, the display easel is maintained in an upright position. A method of forming a display easel is also provided which enables the display easel to be rapidly and economically manufactured in large quantities, such as through the use of web press equipment.

23 Claims, 6 Drawing Sheets

FIG. 18
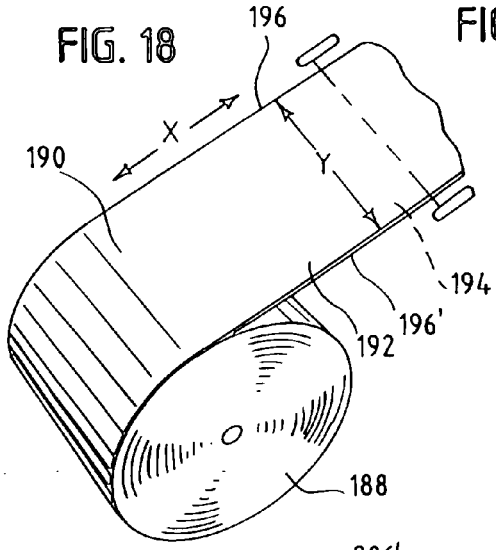
FIG. 19
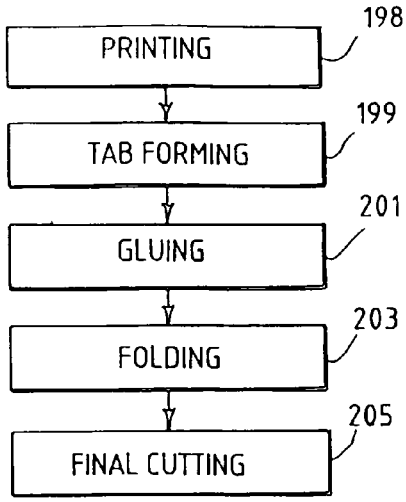
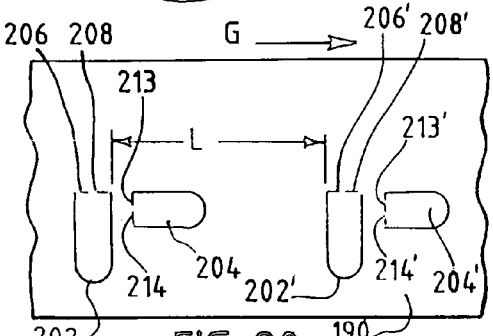
FIG. 20
FIG. 23
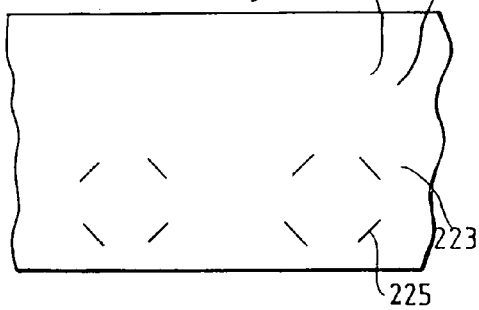
FIG. 24
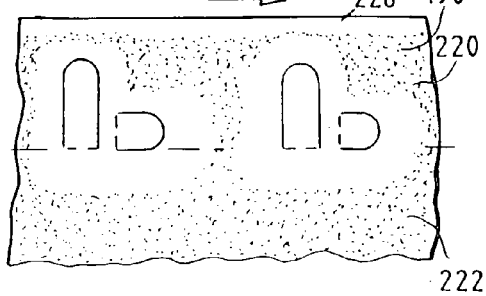
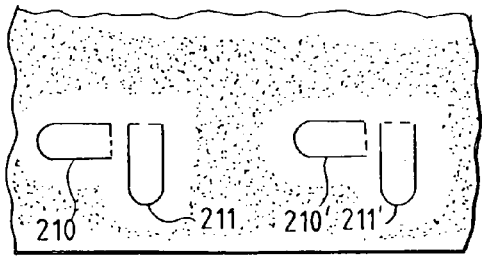
FIG. 21
FIG. 22
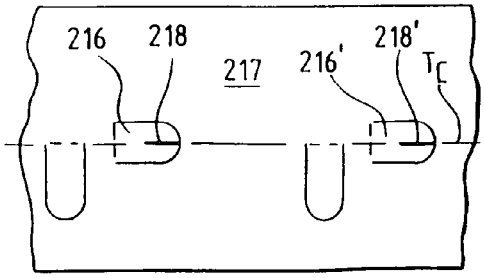
FIG. 25
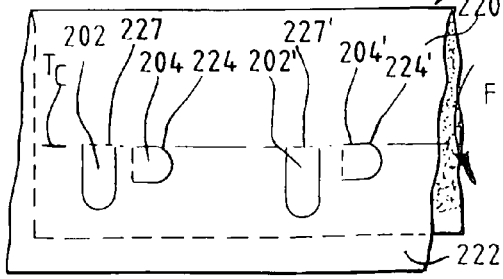

DISPLAY EASEL, DEVICE AND METHOD

FIELD OF THE INVENTION

This invention relates to a novel display easel and to a method of mass producing the novel display easel and resulting products from a single continuous web of thin, flexible material.

BACKGROUND OF THE INVENTION

Various display devices are known in the art. One type of advertisement display device may be folded and assembled such that the advertising device stands erect on a flat surface, such as a restaurant table. These advertising devices may be used to display food specials, drink specials, or other information, for example. The use of such advertisement devices are not limited to restaurants, but are also often used in other locations to provide information. Due to the widespread use of such advertising devices, there is a need for an efficient method of mass manufacturing the devices in a cost-effective manner.

The manual assembly of display devices is generally cumbersome and time consuming. Thus, such devices cannot be efficiently assembled, which is especially disadvantageous when a large number of such devices are required. Further, known display devices are generally only able to rest on a surface in a single position and at a fixed angle, and therefore, do not allow the user to vary the angle or position of the displayed information. Therefore, known prior art display devices have limited versatility and ease of use.

A need also exists for a display easel that allows the user to change advertisements associated with the easel.

Therefore, there is a need for an inexpensive, versatile display device that can be made in a cost-effective manner in large quantities.

SUMMARY OF THE INVENTION

In accordance with the present invention, a novel display easel is provided that can be economically produced and is easy to deploy. An inventive method is also provided for mass producing various embodiments of a novel display easel in bulk from a single continuous web of thin, flexible material.

In accordance with one aspect of the present invention, the display easel comprises a first or base panel defining a panel body. The base panel may be formed of a single sheet of a thin, flexible material such as paper having a thickness of about 0.007 inches. The panel body includes a front side, a rear side, and a bottom edge. Alternatively, one or more sheets may be laminated or secured together to form the base panel, such as multiple layers of paper, each having a thickness of up to about 0.007 inches, for example.

On the rear side of the base panel, there are two tabs that are formed in the base panel, preferably by die-cutting. One of the tabs is a generally horizontal supporting tab to support the display easel in an erect position when deployed and the other of the tabs is a vertical restraining tab which restrains movement of the horizontal supporting tab when deployed. Preferably, the tabs are formed in the rear of the base panel and extend entirely through the base panel. This can be readily accomplished, for example, by forming the tabs in a first layer or sheet on either side of the base panel and thereafter attaching another layer or sheet over the first layer having the tabs formed therein.

The horizontal supporting tab is disposed on the rear side of the first panel substantially parallel to the bottom edge of the first panel. A side edge of the horizontal supporting tab defines or forms a hinge for the supporting tab. The hinge enables movement of the horizontal supporting tab relative to the base panel, preferably by at least about 90 degrees, and preferably greater than 90 degrees, into a position for supporting the display easel. Preferably, the side edge is also perforated, scored or otherwise weakened in a straight line to define the hinge relative to which the horizontal supporting tab can be deployed relative to the base panel by a user. The hinge may be deployed by folding the first tab outwardly from the base panel along the side edge. The hinge may also be formed by the user in the absence of the side edge having perforations, scoring or being otherwise weakened by folding the first tab outwardly from the base panel.

The vertical restraining tab should be located in spaced vertical relation to the side edge of the supporting tab on the rear side of the base panel of the display panel. In one embodiment, the vertical restraining tab is vertically spaced above the side edge of the horizontal supporting tab. In another embodiment, the vertical restraining tab is spaced vertically below the side edge of the horizontal supporting tab. The vertical restraining tab has a generally horizontal edge that defines a hinge for the vertical restraining tab. Preferably, the generally horizontal edge is also perforated, scored or otherwise weakened to provide a straight edge from which the tab can be deployed relative to the base panel by a user. The vertical restraining tab enables movement of the vertical restraining tab relative to the base panel, in an amount adequate to restrain the horizontal supporting tab, which typically will be from 120 to about 160 degrees, and preferably by about 150 degrees. When both the horizontal supporting tab and vertical restraining tab are deployed, the vertical restraining tab abuts a portion of the supporting tab to restrain movement of the supporting tab in a deployed position about 90 degrees relative to the base panel. In this position, the display easel is fully assembled and can rest in a relatively upright position on a flat, generally horizontal surface. The memory of the panel can be used to keep the tabs in place and deployed. For example, the supporting tab may exert a spring force tending to cause it to return to its undeployed position to help hold the restraining tab by frictional engagement.

In accordance with another aspect of the invention, the first or base panel or planar member is composed of a rear panel or sheet and further comprises at least another panel or sheet secured or laminated to the front side of the rear or first panel. Preferably, the other panel(s) is (are) secured to the front side of the rear panel via an adhesive such that at least a substantial portion or alternatively substantially all of the front side of the rear panel or sheet is secured to a rear side of the other panel or sheet. Alternatively, the two or more panels or sheets may be secured to one another by any suitable structure including staples, tape, clips, or any other suitable material, for example.

In accordance with another aspect of the present invention, the side edge of the horizontal supporting tab and a side edge of the vertical restraining tab both can be located at approximately a transverse center of the first panel. Also, the generally horizontal edge of the vertical restraining tab can be disposed in perpendicular relation to the side edge of the horizontal supporting tab.

In accordance with another aspect of the present invention, the vertical restraining tab further includes a generally vertically disposed restraining or locking slit. Preferably, the side edge of the horizontal supporting tab and the restraining slit are both located at approximately the transverse center of the first panel. When both the horizontal supporting tab and vertical restraining tab are deployed, the restraining slit can receive the horizontal supporting tab therein, which can be by a frictional fit, to restrain movement of the supporting tab when in a deployed position. Preferably, the deployed position is at least about 90 degrees relative to the base panel. In this position, the display easel can be positioned in a self-supporting, standing position and may rest on a flat surface.

In accordance with another aspect of the present invention, the display easel includes at least one additional panel that is attached to the base panel. The additional panels may comprise coupons, calendar pages, joke pages, menu listings, advertisements, book pages, or any other desired printed or unprinted materials, typically in sheet form. Preferably, the additional panels are attached at least in the area of or adjacent to a peripheral edge of the panel body, but may otherwise be attached to the base panel as desired. In one embodiment, the additional panel or panels or at least some of them are of a different size and shape than the base panel. In another embodiment, the additional panel or panels or at least some of them are of substantially the same size and shape as the base panel and may contain human readable printed indicia or matter. Thus, the resulting easel product may be a calendar, a book or booklet, for example.

Alternatively, the additional panels may comprise a plurality of overlaying panels wherein at least one panel may be flipped from a front position relative to the front side of the base panel to a rear position relative to the front side of the base panel.

In accordance with another aspect of the present invention, the display easel comprises a front portion that includes at least one slit, and preferably a plurality of spaced apart slits, for retaining a separate generally planar object therein, such as a postcard or photograph.

In accordance with yet another aspect of the present invention, a method for making a display easel is provided. The method is particularly suitable for web press equipment which equipment and the use thereof is well known in the art. The method includes:

periodically forming a plurality of longitudinally spaced horizontal tabs in a web or in an elongated strip of thin, flexible material;

periodically forming a plurality of longitudinally spaced vertical tabs in the material, wherein the vertical restraining tabs are spaced in vertical relation to the side edge of the horizontal supporting tab; and periodically transversely cutting the web or elongated strip into a plurality of individual display easels or products in accordance with the invention.

The method may further comprise, for each horizontal tab, forming a first hinge extending along a side edge of the horizontal tab and also for each vertical tab, forming a second hinge extending along a generally horizontal edge of the vertical tab.

In accordance with another aspect of the present invention, the method further includes longitudinally dividing or slitting the web or elongated strip of flexible material to form at least two ribbons or narrower strips, wherein each ribbon or narrower strip is formed into products in accordance with the invention. When slit into separate ribbons, any embodiment of a method of the present invention as described herein may be performed on each ribbon as desired, and particularly to produce a large quantity of display easels in accordance with the invention.

In accordance with another method aspect of the present invention, the elongated strip comprises a first longitudinal portion and a second longitudinal portion. The horizontal tabs and the vertical tabs are periodically formed on the first longitudinal portion of the elongated strip as discussed. The method of the present invention may further include applying an adhesive to the second longitudinal portion for securing the first longitudinal portion to the second longitudinal portion and folding the elongated strip to overlap the first longitudinal portion on a second longitudinal portion of the elongated strip to form a display easel composed of two attached panels.

In accordance with another aspect of the present invention, the method further includes periodically forming the plurality of horizontal tabs and vertical tabs such that a side edge of a horizontal tab and a side edge of a vertical tab are located at approximately the transverse center of the secured longitudinal portions.

In an alternate embodiment, the first longitudinal portion is folded on the second longitudinal portion at least twice to form a display easel having a plurality of panels. In yet another embodiment, the elongated strip is folded such that the first longitudinal portion overlaps the second longitudinal portion of the elongated strip. The first longitudinal portion and the second longitudinal portion are then attached to one another by any suitable method, such as by gluing, taping, clipping, or stapling.

In accordance with another aspect of the present invention, the forming of a plurality of longitudinally spaced vertical tabs on the elongated strip further includes forming a vertically disposed longitudinal slit on each vertical tab.

In accordance with another aspect of the present invention, the method includes forming at least one slit, and preferably a plurality of spaced apart slits in a predetermined array or relationship, in the front side of the second longitudinal portion of the elongated strip for retaining a separate generally planar member or sheet therein, which may be a photograph, for example.

In accordance with yet another aspect of the present invention, the method further includes attaching a plurality of additional panels to the elongated strip. In one embodiment, one or more of the additional panel or panels are of substantially the same size and shape as the resulting base panel or cut display easel. In another embodiment, one or more of the additional panel or panels are of a different size and shape than the resulting cut display easel.

In accordance with yet another aspect of the present invention, the method includes transversely folding the elongated strip at a location on the elongated strip such that the resulting transversely cut display easel comprises at least two panels which are hingedly connected to one another at an intersecting edge of the at least two panels.

Other advantages and features of the invention will become apparent from the following description and from reference to the drawings.

BRIEF DESCRIPTION OF THE DRAWINGS

FIG. 18 is a perspective view illustrating a portion of a web or elongated strip for use in accordance with the invention;

FIG. 19 is a schematic representation illustrating the different operations that can be used in a method in accordance with the invention;

FIG. 20 is a top plan view illustrating the forming of tabs in a web or elongated strip in accordance with the invention;

FIG. 21 is a top plan view illustrating another embodiment of periodic forming of tabs in a web or elongated strip in accordance with the invention;

FIG. 22 is a top plan view illustrating the periodic forming of vertically disposed slits in the vertical tabs in accordance with the invention;

FIG. 23 is a top plan view illustrating the periodic forming of slits on a second longitudinal portion of an elongated strip in accordance with the invention;

FIG. 24 is a top plan view illustrating the periodic applying adhesive to a portion of a first longitudinal portion of an elongated strip in accordance with the invention;

FIG. 25 is a top plan view illustrating the periodic folding of a first longitudinal portion on a second longitudinal portion of an elongated strip in accordance with the invention;

DETAILED DESCRIPTION OF THE INVENTION

Figure 1:
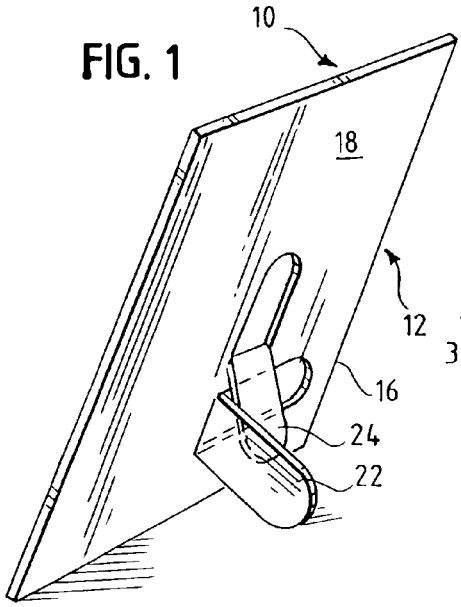
FIG. 1 is a rear perspective view of a deployed easel in accordance with the invention.

While this invention is susceptible of embodiment in many different forms, there is shown in the drawings and described in detail herein, several specific embodiments with the understanding that the present disclosure is to be considered as exemplifications of the principles of the invention and is not intended to limit the invention to the embodiments illustrated.

Figure 1A:
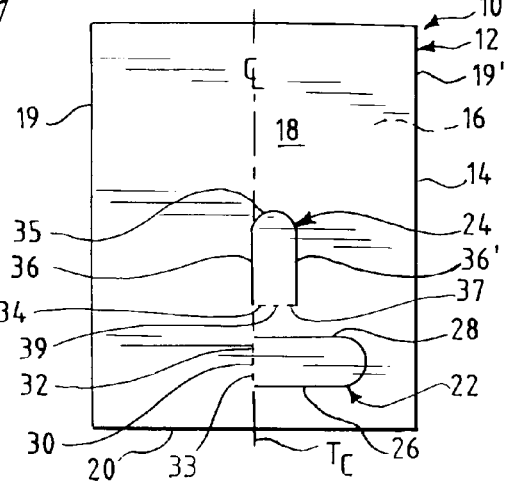
FIG. 1A is a rear elevation view illustrating the base panel of the display easel of FIG. 1 in an undeployed position.

In accordance with the invention, a display easel is provided which is easy and economical to produce in large quantities and which provides many display options for the user. As shown in FIGS. 1 and 1A, a display easel 10 comprises a first or base panel 12 which may be composed of two or more sheets or layers 14 of paper or other suitable material constructed of a thin, flexible material. In a preferred embodiment, base panel 12 is constructed of one, two or more layers of paper, each having a thickness of up to about 0.007 inches. A typical size for base panel 12 is 5 inches by 5 inches, but any other suitable size as desired may be used, as will be appreciated by those skilled in the art. Base panel 12 includes a front sheet 16, a rear sheet 18, side edges 19, 19' and a bottom edge 20. There are two tabs cut into rear sheet 18, a horizontal supporting tab 22, and a vertical restraining tab 24. Preferably, tabs 22, 24 are die-cut into rear sheet 18 of base panel 12. Alternatively, the tabs may be perforated, or formed in rear sheet 18 by any other suitable method. Tabs 22 and 24 may extend through one or more layers or sheets of base panel 12 as desired but preferably do not extend through the front layer or sheet of the base panel.

Figure 2:
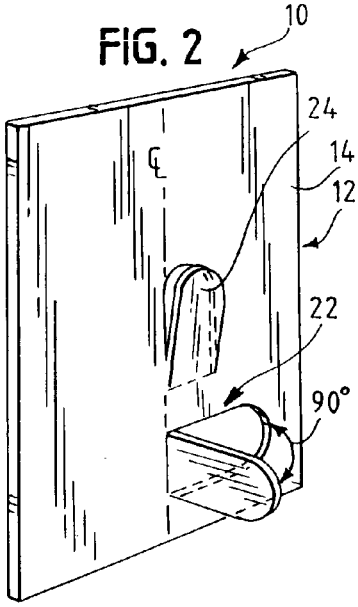
FIG. 2 is a rear elevation view illustrating the movement of a horizontal supporting tab of the easel of FIG. 1.

As shown in FIGS. 1-2, horizontal supporting tab 22 has a bottom edge 26 which is disposed substantially parallel to bottom edge 20 of base panel 12. Additionally, horizontal supporting tab 22 includes a top side edge 28, and a side edge 30 that defines a hinge 32 for horizontal supporting tab 22. Hinge 32 enables movement of horizontal supporting tab 22 relative to base panel 12 in the direction shown by arrow A in FIG. 2 such that horizontal supporting tab 22 may be moved to a position at least about 90 degrees relative to base panel 12. Side edge 30 comprises perforations 33 to provide a straight edge from which horizontal supporting tab 22 can more easily be deployed by a user.

As shown in FIG. 1A, vertical restraining tab 24 has a generally horizontal edge 34, top curved edge 35, and side edges 36, 36'. In one embodiment, as shown in FIG. 1A, vertical restraining tab 24 is spaced vertically above side edge 30 of horizontal supporting tab 22. Preferably, side edge 30 of horizontal supporting tab 22 and side edge 36 of vertical restraining tab 24 are both located at approximately the transverse center ("Tc") of the first panel and generally horizontal edge 34 of vertical restraining tab 24 is spaced in substantially perpendicular relation to side edge 30 of horizontal supporting tab 22.

Figure 3:
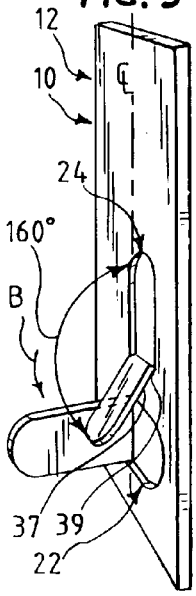
FIG. 3 is a rear elevation view illustrating the movement of a vertical restraining tab of the easel of FIG. 1.

Generally horizontal edge 34 of vertical restraining tab 24 also defines a second hinge 37 which enables movement of vertical restraining tab 24 from between about 120 degrees to about 160 degrees, preferably about 150 degrees, relative to base panel 12, as shown in FIG. 3 by arrow B. Preferably, generally horizontal edge 34 of vertical restraining tab 24 comprises perforations 39 in a straight line for ease of deployment of second hinge 37 from base panel 12.

Alternatively, edges 30 and 34 may be merely folded in-situ during deployment to form hinges 32 and 37, respectively, when tabs 22 and 24 are each deployed from rear sheet 18 of base panel 12, so that perforations or a pre-formed fold is not required.

Figure 4:
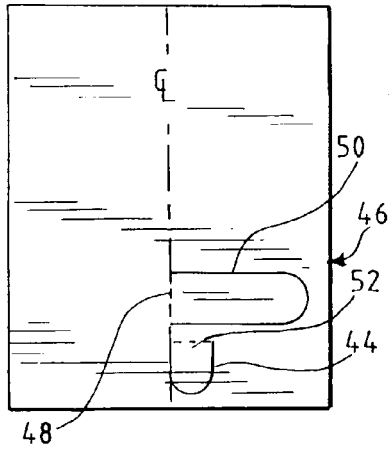
FIG. 4 is a rear elevation view illustrating the rear side of the first panel of another embodiment of a display easel in accordance with the invention.

In an alternate embodiment, as shown in FIG. 4, vertical restraining tab 44 of first panel 46 is spaced vertically below a side edge 48 of the horizontal supporting tab 50 and a generally horizontal edge 52 of vertical restraining tab 44 is spaced in substantially perpendicular relation to side edge 48 of supporting tab 50.

Figure 5:
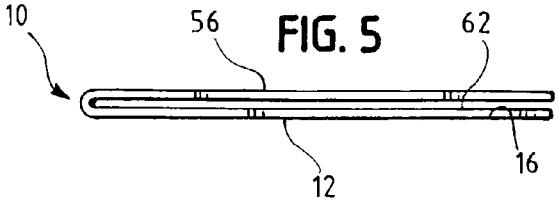
FIG. 5 is a side elevation view illustrating a display easel in an undeployed position and having a base panel attached to a first panel in accordance with the invention.

In accordance with another aspect of the invention, display easel 10 further comprises a front panel 56 secured to front sheet 16 of base panel 12. A side view of the configuration is shown at FIG. 5. Preferably, front panel 56 is secured to front sheet 16 of base panel 12 via an adhesive 62 such that substantially all of front panel 56 is adhered to base panel 12. Alternatively, the two panels may be secured to one another via staples, tape, clips or any other suitable material. With a front panel secured to a rear panel, the display easel is resistant to flex and deformation.

Figure 6:
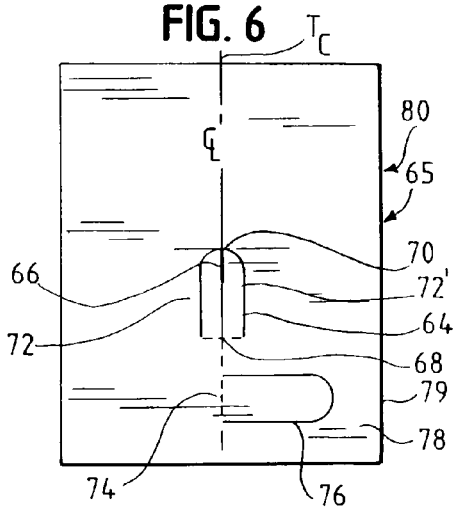
FIG. 6 is a rear elevation view illustrating a display easel having a vertical restraining tab which includes a generally vertically disposed restraining or locking slit in accordance with the invention.

In another aspect of the present invention, vertical restraining tab 64 of display easel 65 includes a generally vertically disposed locking slit 66, as shown in FIG. 6. Vertical restraining tab 64 has a generally horizontal edge 68, a top curved portion 70, and side edges 72, 72'. Vertical restraining tab 64 is spaced in vertical relation to a side edge 74 of horizontal supporting tab 76 on rear side 78 of rear sheet 79 of base panel 80. Preferably, vertical restraining tab 64 is spaced vertically above side edge 74 of horizontal supporting tab 76. Locking slit 66 is generally vertically disposed on vertical restraining tab 64 and extends from top curved portion 70 of vertical restraining tab 64. Preferably, side edge 74 of horizontal supporting tab 76 and locking slit 66 are both located at approximately the transverse center ("$T_C$") of base panel 80. Further, generally horizontal edge 68 of vertical restraining tab 64 is preferably spaced in substantially perpendicular relation to side edge 74 of horizontal supporting tab 76.

Figure 7:
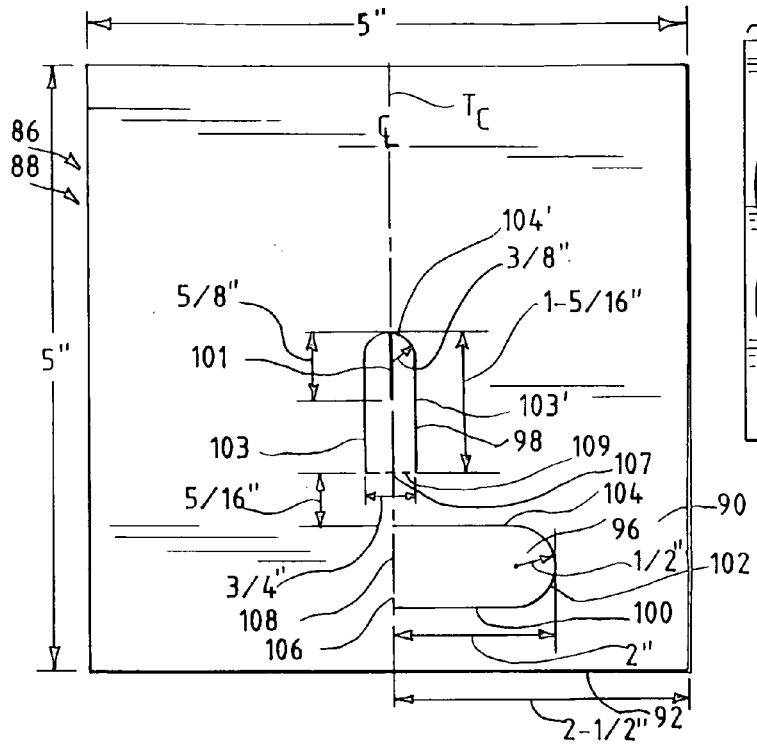
FIG. 7 is a rear elevation view illustrating the rear side of the base panel of another embodiment of a display easel in accordance with the invention.

A specific embodiment of the rear side of the first panel of a display easel 86 having a locking slit is shown in FIG. 7. Display easel 86 has a base panel 88 including a rear side 90, and a bottom edge 92. Rear side 90 includes a horizontal supporting tab 96 and a vertical restraining tab 98. Horizontal supporting tab 96 has a bottom edge 100, a curved edge 102, a top edge 104, and a side edge 106 which defines a hinge 108 for horizontal supporting tab 96. Vertical restraining tab 98 has a generally vertical restraining or locking slit 101, side edges 103, 103', curved top edge 104', and a generally horizontal edge 107 which defines a hinge 109 for vertical restraining tab 98. A line $T_c$ travels through the approximate transverse center of base panel 88. Locking slit 101 of vertical restraining tab 98 and side edge 106 of horizontal supporting tab 96 lie at approximately transverse center ("$T_C$") of base panel 88. Further, locking slit 101 has a vertical length of about ⅝ inch extending from curved edge 104' of locking slit 101.

In this particular embodiment, base panel 88 has a length of about 5 inches and a height of about 5 inches. Horizontal supporting tab 96 measures about 2 inches in length and has a height of approximately 1 inch. The approximate radius of curvature for curved edge 102 for horizontal supporting tab 96 is about ½ inch. Generally horizontal edge 107 of vertical restraining tab 98 is spaced vertically above side edge 106 of horizontal supporting tab 96, and more particularly is spaced vertically above top edge 104 of horizontal supporting tab 96 by about 5/16 inch. Vertical restraining tab 98 measures about ¾ inch in length and has a height of approximately 1 5/16 inch and the approximate radius of curvature for curved edge 104' of vertical restraining tab 98 is about ⅜ inch.

Figure 7A:
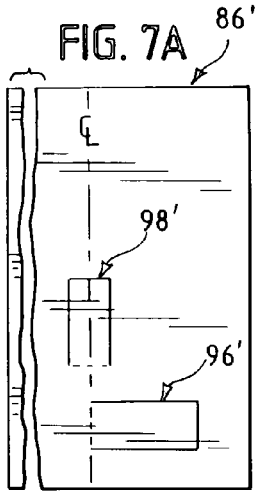
FIG. 7A is a rear elevation view illustrating a display easel having a vertical restraining tab and a horizontal supporting tab with squared corners.

Alternatively, if desired, one or more tabs may have square corners as illustrated in FIG. 7A, as desired, where tabs 96' and 98' are illustrated as part of easel 86' which is otherwise similar to easel 86.

Figure 8:
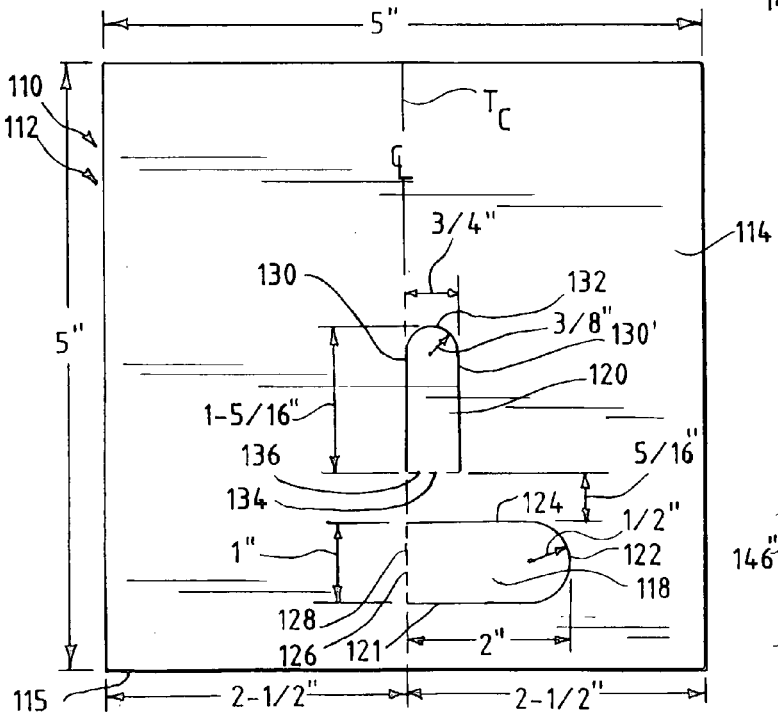
FIG. 8 is a rear elevation view illustrating the rear side of the base panel of another embodiment of a display easel in accordance with the invention.

A specific embodiment of the rear side of the first panel of a display easel having no locking slit is shown in FIG. 8. Display easel 110 has a base panel 112 having a rear side 114, and a bottom edge 115. Rear side 114 includes a horizontal supporting tab 118 and a vertical restraining tab 120. Horizontal supporting tab 118 has bottom edge 121, curved edge 122, top edge 124, and a side edge 126 which defines a hinge 128 for horizontal supporting tab 118. Vertical restraining tab 120 has side edges 130, 130', a curved edge 132, a generally horizontal edge 134, which defines a hinge 136 for vertical restraining tab 120. A line $T_C$ defines the approximate transverse center of base panel 112. Side edge 130 of vertical restraining tab 120 and side edge 126 of horizontal supporting tab 118 lie at approximately transverse center $T_c$ of easel 110.

In this embodiment, base panel 112 has a length of 5 inches and a height of about 5 inches. Horizontal supporting tab 118 measures about 2 inches in length and has a height of approximately 1 inch. The approximate radius of curvature for curved edge 122 of horizontal supporting tab 118 is about ½ inch. Generally horizontal edge 134 of vertical supporting tab 120 is spaced vertically above side edge 126 of horizontal supporting tab 118, and more particularly is spaced vertically above top edge 124 of horizontal supporting tab 118 by about 5/16 inch. Vertical restraining tab 120 measures about ¾ inch in length and has a height of approximately 1 5/16 inch. The approximate radius of curvature for curved edge 132 of vertical restraining tab 120 is about ⅜ inch.

Figure 9:
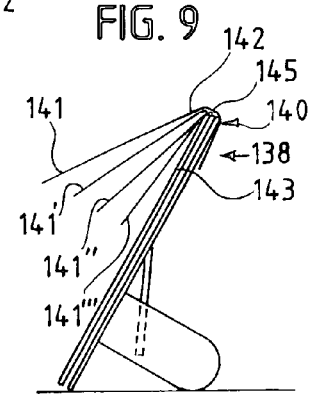
FIG. 9 is a side elevation view illustrating a display easel having a plurality of additional panels attached to a base panel in accordance with the invention.

In accordance with another aspect of the present invention, a display easel 138 includes at least one additional panel or page attached to base panel 140. For example, four additional panels 141, 141', 141", 141'" may be attached to base panel 140, as shown in FIG. 9. Any desired number of panels or pages can be attached to base panel 140. As illustrated, additional panels 141, 141', 141", 141'" are attached to a front side 142 of a front sheet 143 which forms part of base panel 140. Additional panels 141, 141', 141" and 141'" may be coupons, calendar pages, joke pages, menu listings, advertisements, or any other desired printed or unprinted materials. Also, the additional panels may be of the same material as the base panel 140, or alternatively may be any other substrate that is attachable to base panel 140. For example, a plastic cover could be attached to the base panel 140 if desired. Thus, the resulting devices may be a book or a calendar, for example.

Preferably, the additional panels are attached to or adjacent an edge, such as top edge 145 of base panel 140, shown in FIG. 9. In one embodiment, the additional panels are of a different size and shape from base panel 140. For example, the additional panels may comprise a plurality of registered thin-cut calendar or note pages. In another embodiment, the additional panels are of substantially the same size and shape as base panel 140. In either embodiment, the panels may be registered and attached to base panel 140 by any suitable binding material or by any suitable method.

Figure 10:
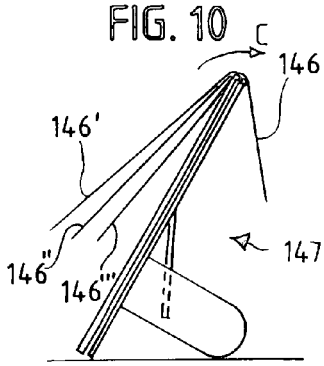
FIG. 10 is a side elevation view illustrating a display easel having a plurality of overlying panels in accordance with the invention.

Alternatively, as shown in FIG. 10 for easel 147, the additional panels or pages may comprise a plurality of overlaying panels 146, 146', 146", 146'" where at least one panel 146 may be flipped in the direction shown by arrow C from a front position relative to display easel 147 to a rear position relative to display easel 147.

Figure 11:
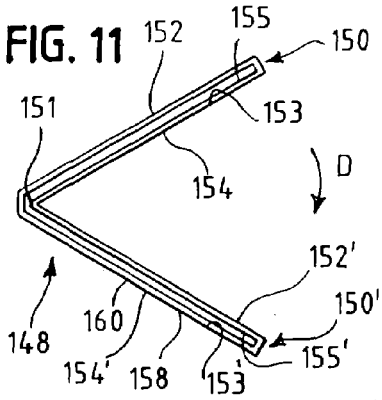
FIG. 11 is a side elevation view illustrating a display easel having two sets of attached panels in accordance with the invention.

In another aspect of the present invention, the display easel may comprise a combination of attached panels and unattached panels. For example in one embodiment, as schematically shown in FIG. 11, a display easel 148 comprises at least two sets of attached panels 150, 150', each set having a front panel 152, 152' attached to a front side 153, 153' of a first panel 154, 154', preferably via an adhesive 155, 155'. A fold-line 151 may be created between two sets of attached panels 150, 150' to enable display easel 148 to swing open in the direction as shown by arrow D. At least one panel has a horizontal supporting tab 158 and a vertical restraining tab 160 which may be configured as previously described with respect to FIGS. 1-10 and can be deployed to give display easel 148 an angled appearance and added stability when standing.

Figure 12:
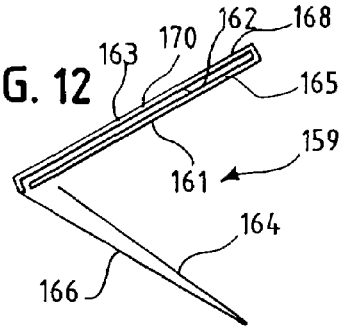
FIG. 12 is a side elevation view illustrating a display easel having a pair of attached panels and two unattached panels in accordance with the invention.

In another embodiment, as shown schematically in FIG. 12, display easel 159 has front panel 161 attached or laminated face-to-face to front side 162 of base panel 163, preferably by an adhesive 165, and at least one panel, for example panels 164, 166, which are not attached face-to-face with one another panel. It is contemplated that any mixture of face-to-face attached panels and single panels may be used. At least one panel of display easel 159 may have a horizontal supporting tab 168 and a vertical restraining tab 170 to be deployed to give display easel 159 an angled appearance and added stability.

Figure 13:
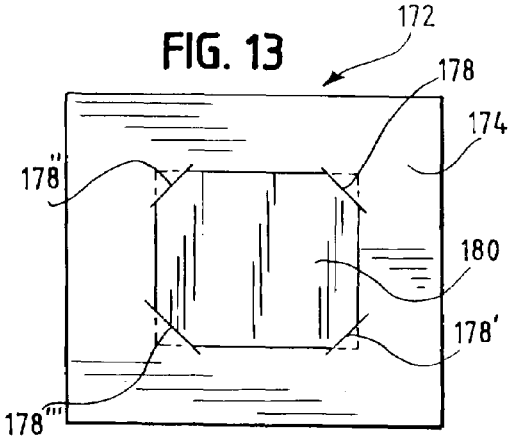
FIG. 13 is a front elevation view illustrating a display panel including a front panel having a plurality of slits in accordance with the invention.

In accordance with another aspect of the present invention, as shown in FIG. 13, display easel 172 comprises a sheet 180 attached to base panel 174. Base panel 174 includes a plurality of spaced apart slits 178, 178', 178", 178'" for retaining a separate generally planar object therein such as in this case sheet 180 which may be a postcard or photograph 180. For example, slits 178, 178', 178", 178'" form a rectangular shape and size such that a 3½"×4" photograph may fit within said slits to be displayed when the first panel is the preferred 5"×5" size. It is contemplated that base panel 174 may include any number and configuration (curved or straight, for example) of slits and such slits may collectively define any shape as desired. Further, it is contemplated that photographs, menus, wine lists, specials, coupons can be retained within the slits and inserted and removed as desired by the user.

Figure 14:
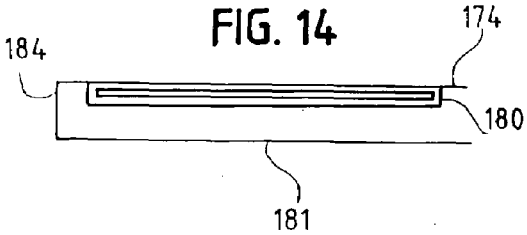
FIG. 14 is a side elevation schematic view illustrating a display easel having a plurality of slits, a generally planar object retained therein, and a protective front panel in accordance with the invention.

In accordance with another embodiment of the present invention, as shown in FIG. 14, display easel 172 further includes an additional panel 181 hingedly connected to an edge 184 of sheet 180 for protecting sheet 180 or any other item retained within slits 178, 178', 178", 178'".

Figure 15:
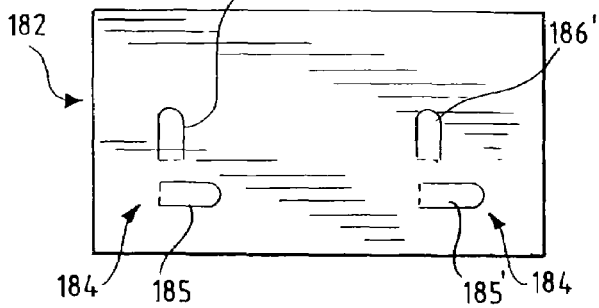
FIG. 15 is a rear elevation view of another embodiment of a display easel in accordance with the present invention having two pairs of horizontal supporting and vertical restraining tabs.

In accordance with another aspect of the present invention, the display easel includes a plurality of pairs of a horizontal supporting tab and a vertical restraining tab. Though one preferred size of the display easel of the present invention is a 5 inch by 5 inch display easel, it is contemplated that the display easel of the present invention may be of any desired size. When a display easel is of a more substantial size, it can be advantageous for the display easel to have a plurality of pairs of horizontal supporting and vertical restraining tabs to more fully support the display easel. For example, as shown in FIG. 15, display easel 182 has a pair of horizontal supporting tabs 185, 185' and a pair of vertical restraining tabs 186, 186' and each pair may be deployed to erect and stand display easel 182 in a stable manner. It is contemplated that any display panel having a relatively large size may include two, three, or four or more sets of tabs as desired.

In operation, the display easel of the present invention having no locking slit may be readily deployed and used as follows. The user may grasp base panel 12 with one hand while pulling horizontal supporting tab 22 in a direction away from the body such that the horizontal tab 22 is spaced, for example, at least about 90 degrees from base panel 12, as shown in FIG. 2. Next, the user may pull vertical restraining tab 24 in a direction away from base panel 12 such that vertical restraining tab 24 is disposed, for example, between about 120 degrees and about 160 degrees, and preferably about 150 degrees, from base panel body 12, as shown in FIG. 9. When vertical restraining tab 24 is at the desired angle relative to base panel body 12, the user allows vertical restraining tab 24 to abut a portion of horizontal supporting tab 22 and releases his grasp on tabs 22, 24.

Figure 16:
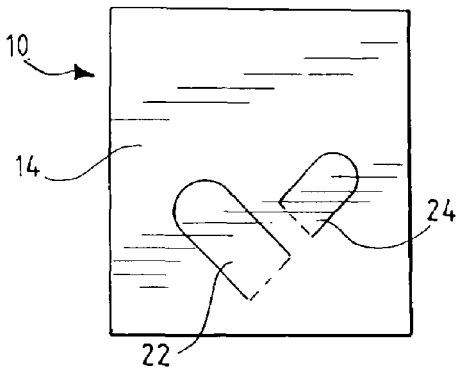
FIG. 16 is a rear elevation view of a vertical restraining tab for restraining movement of a horizontal supporting tab in accordance with the invention.

Vertical restraining tab 24 abuts horizontal supporting tab 22 and prevents horizontal supporting tab 22 from moving within about 90 degrees relative to base panel body 12. Thus, vertical restraining tab 24 prevents horizontal supporting tab 22 from returning to an original undeployed position, as shown in FIG. 16. It is contemplated that horizontal tab 22 of the present invention should be of a horizontal length and be of such a distance relative to bottom edge 20 of first panel 12 to enable supporting tab 22 to support display easel 10 in an upright position. Additionally, top edge 35 of vertical tab 24 preferably should not extend past horizontal tab 22 when deployed.

Figure 17A:
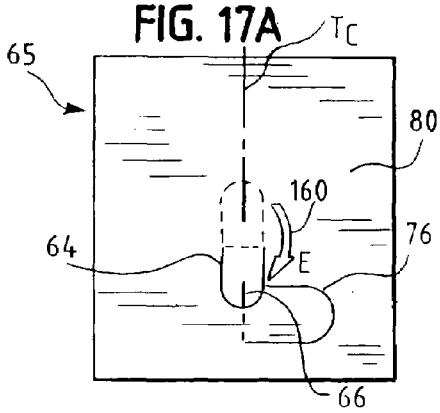
FIG. 17A is a rear elevation view of an inventive easel illustrating a movement of a vertical restraining tab having a generally vertically disposed locking slit in accordance with the invention.
Figure 17B:
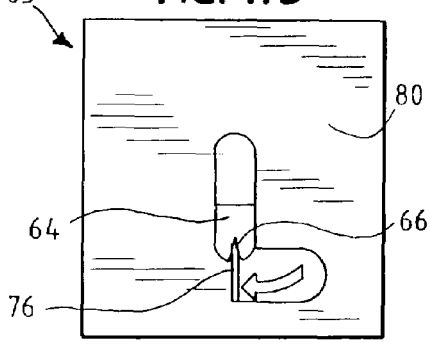
FIG. 17B is a rear elevation view of an inventive easel illustrating a vertical restraining tab having a generally vertically disposed locking slit restraining movement of a horizontal supporting tab in accordance with the invention.

In operation, the display easel of the present invention having a vertically disposed locking slit may be assembled as follows. As shown in FIG. 17A, the embodiment of FIG. 6 is shown after deploying horizontal supporting tab 76 such that horizontal supporting tab 76 is spaced at least about 90 degrees from base panel 80, the user may pull and deploy vertical restraining tab 64 in a direction away from base panel 80 as shown by Arrow E such that vertical restraining tab 64 is disposed between about 120 degrees and about 160 degrees from base panel 80. When vertical restraining tab 64 is at the desired angle relative to base panel 80, the user causes locking slit 66 of vertical restraining tab 64 to receive a portion of horizontal supporting tab 76 within locking slit 66 and releases his grasp on tabs 64 and 76, as shown in FIG. 17B. Vertical restraining tab 64 prevents any movement of horizontal supporting tab 76 generally within about 90 degrees relative to rear sheet 79. In its fixed position, horizontal supporting tab 76 is in a position for supporting display easel 65.

In accordance with another aspect of the present invention, a method for manufacturing a display easel and resulting device which may be a book, a calendar, a photograph display or other device is provided which utilizes a web printing press and in-line finishing techniques and methods. Web printing presses, including the operation thereof, are well known in the art and therefore are not described herein. A web or elongated strip of thin, flexible material is provided to be used in the web printing press equipment. The web may be, for example, between 15 and 38 inches in width and come from a large roll of, for example, 40 to 50 inches in diameter with a paper weight between 1000 and 4000. The web comprises an elongated strip of flexible material having a length (x) and a width (y). Any desired size web of paper can be utilized in the method of the present invention as will be set forth below. The web is preferably paper, and more preferably paper having a thickness of about 0.007 inches, but alternatively may be plastic, film, or any other substrate.

As shown in FIG. 18, roll 188 of thin, flexible material is properly inserted into the web printing press such that the roll dispenses a continuous elongated strip or web 190 of thin, flexible material on which the steps of the method may be performed. Elongated strip or web 190 has an upper surface 192, lower surface 194, and side edges 196, 196'. An automatic splicing machine (not shown) may be provided for roll to roll change without interruption. Web 190 is fed into a web press by an in-feed unit (not shown) of variable speed, preferably set to a paper tension of, for example, between about 3 to about 12 pounds per lineal inch to a plurality of processing operations. The various operations are shown schematically in FIG. 19 as printing operation 198, tab-forming operation 199, gluing operation 201, folding operation 203, and final cutting operation 205, the gluing and folding operations being optional for the method of the present invention. While FIG. 19 represents a preferred sequence of operations, it is contemplated web 190 may travel through the various operations in any other order as desired.

First, elongated strip 190 travels from the in-feed unit to printing operation 198. In printing operation 198, elongated strip 190 may be printed on both upper surface 192 and lower surface 194 by one or more printing units. Preferably, each printing unit may print one color onto the substrate. Perfecting units may be used to simultaneously print on upper surface 192 and lower surface 194 of the same web material. Subsequently, elongated strip 190 may travel through a drying oven where solvents from the ink are vaporized. Elongated strip 190 is then cooled to ambient temperature.

From printing operation 198, elongated strip 190 travels to tab-forming operation 199, which may be at a speed of about 1000 ft/min, for example, wherein a plurality of horizontal tabs 202, 202' and vertical tabs 204, 204' are periodically cut or formed by any suitable method in elongated strip 190 at spaced intervals as elongated strip 190 moves in direction shown by arrow G, as shown in FIG. 20. For purposes of all figures set forth herein, the direction of the traveling elongated strip is from left to right, as shown by arrow G. The tab-forming may be performed by any known method, preferably, however, by die-cutting. When tab-forming, elongated strip 190 preferably travels between die-cut blades and a hardened anvil cylinder surface. The die-cut blades cut the desired tabs 202, 202', 204, 204' into elongated strip 190. Alternatively, the horizontal and vertical tabs may be perforated into the elongated strip. The number of horizontal and vertical tabs cut into the elongated strip corresponds to the desired output and size of the final display easel product.

More particularly, the horizontal tabs are cut at spaced intervals along the elongated strip. The longitudinal spacing between horizontal tabs 202, 202' may be substantially similar to the desired longitudinal length (L) of the desired easel, but preferably enough space is maintained between successive horizontal tabs 202, 202' to allow for error in measuring and in the subsequent transverse cutting of elongated strip 190. Horizontal tabs 202, 202' are cut such that hinges 206, 206' are formed along side edges 208, 208' of horizontal tabs 202, 202'. In one embodiment, side edges 208, 208' can also be perforated so as to provide a straight edge for hinges 206, 206'. Vertical tabs 204, 204' are periodically formed in elongated strip 190 in vertical relation to side edges 208, 208' of the horizontal tabs 202, 202'. In one embodiment, as shown in FIG. 20, vertical tabs 204, 204' are cut vertically above horizontal tabs 202, 202'.

In another embodiment, as shown in FIG. 21, vertical tabs 210, 210' are cut vertically below the horizontal tabs 211, 211'. In either embodiment, the method may include forming second hinges 213, 213' which extend along generally horizontal edges 214, 214' of vertical tabs 204, 204', as shown in FIG. 20, for example. Additionally, generally horizontal edges 214, 214' may also be perforated so as to provide straight edges for second hinges 213, 213'.

In one embodiment, as shown in FIG. 22, as vertical tabs 216, 216' are cut in elongated strip 217, generally vertically disposed slits 218, 218' may also be formed in vertical tabs 216, 216' as elongated strip 217 travels through tab-forming operation 199 of the web press. Generally vertically disposed slits 218, 218' are preferably cut or formed in the vertical center ("$T_C$") of each vertical tab 216, 216'.

In another aspect of the present invention, as shown in FIG. 23, elongated strip 219 has a first longitudinal portion 221 and a second longitudinal portion 223. A plurality of spaced apart slits 225 may be formed in second longitudinal portion 223 of elongated strip 219. When first longitudinal portion 221 is folded over second longitudinal portion 223 having slits cut therein, and the portions are secured and cut as will be described in detail below, the resulting display easel will have a front side having a plurality of slits which may retain a generally planar object therein such as a postcard or photograph. Any number of slits may be formed in second longitudinal portion 223 and collectively, the slits may define any desired shape such as triangle, rectangle, or square.

Next, as shown in FIG. 24, an adhesive 226 may be applied to a portion of the elongated strip 190 in the pattern shown or as desired in gluing operation 201. After horizontal tabs 202, 202' and vertical tabs 204, 204' are periodically formed on a first longitudinal portion 220 of elongated strip 190, an adhesive 226, such as glue beads, may be applied to an exposed surface of first longitudinal portion 220 or second longitudinal portion 222 of elongated strip 190, readying first longitudinal portion 220 for adhesive attaching to second longitudinal portion 222. Preferably, at least two glue beads are applied to first longitudinal portion 220, but as many beads as is necessary to form a successful union may be used.

Application of the glue beads is preferably accomplished by using individual closed pressure systems. The preferred glue viscosity is equivalent to 20 seconds in a #5 Zahn cup. Glue nozzle size preferably is between 0.02 to 0.035 inches in diameter and the nozzle should be in direct and continuous contact with the traveling elongated strip at an angle of about 30 degrees relative to the web.

Next, in a preferred embodiment, as shown in FIG. 25, elongated strip 190 may enter folding operation 203 where first longitudinal portion 220 is overlapped on second longitudinal portion 222 in the direction shown by arrow F to form a continuous web having two attached portions which will yield a display easel having two attached panels when transversely cut. In this embodiment, horizontal tabs 202, 202' and vertical tabs 204, 204' may be cut in elongated strip 190 such that side edges 224, 224' of vertical tabs 204, 204' and side edges 227, 227' of horizontal tabs 202, 202' are located at approximately the transverse center ("$T_C$") of the attached portions when securement of the two portions is completed.

In another aspect of the present invention, the elongated strip may be folded more than once to form a display easel having a thickness consisting of a plurality of panels. It is critical when folding more than once that the tabs are cut in a portion of the elongated strip wherein they will remain on an exposed surface of the final cut display easel product.

Figure 26:
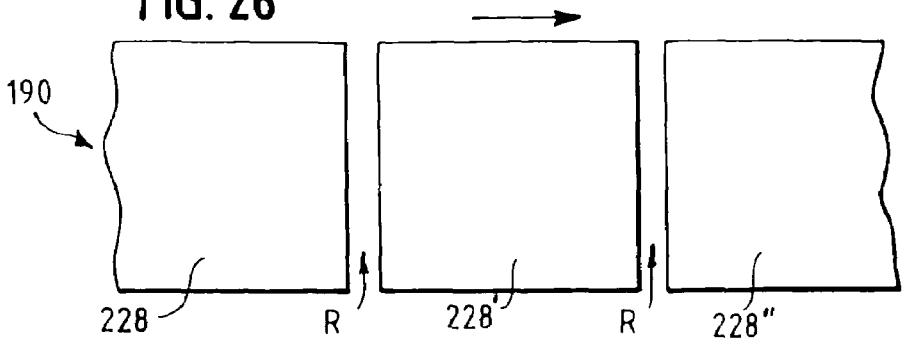
FIG. 26 is a top plan view illustrating schematically the periodic transverse cutting of an elongated portion to provide a number of individual display easels in accordance with the invention.

Next, the processed elongated strip 190 may now be fed through a final cutting operation 205 where a rotary cutter transversely cuts elongated strip 190 at a desired longitudinal length as indicated by arrow R in FIG. 26, into individual display easels 228, 228', 228". Elongated strip 190 may further be cut longitudinally or latitudinally as desired. Finished products can then be assembled to display units by deploying the horizontal supporting tab and vertical restraining tabs as set forth herein.

In another aspect of the present invention, elongated strip 190 may be folded at least once and transversely cut to desired size to form a display easel having at least two panels which are hingedly connected to each other at an intersecting edge of the two panels on a top side, bottom side, or other side of the panels as desired. In another embodiment, elongated strip 190 may be roll-folded to produce a succession of decreasing smaller folded panels.

Figure 29:
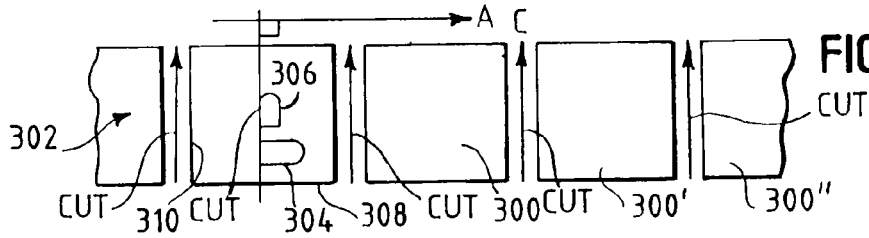
FIG. 29 is a top plan view illustrating schematically the periodic transverse cutting of each elongated strip into a plurality of additional panels in accordance with the present invention.

Additionally, a plurality of additional panels 300, 300', 300" may be added to elongated strip 302 to form a display easel having a plurality of additional panels attached to a perimeter of the base panel, such as top edge of the base panel, as in FIGS. 9-10. In one embodiment, such an easel may be formed by attaching a plurality of additional panels 300, 300', 300" to elongated strip 302 where each component of the final cut display easel is formed from the same elongated strip. As shown in FIG. 29, additional panels 300, 300', 300" may be transversely cut in the direction shown by arrow C in succession on elongated strip 302, registered, and attached to a portion of elongated strip 302 such that the additional panels overlay at least a pair of horizontal tabs 304 and vertical tabs 306 die-cut in elongated strip 302.

When a plurality of final cut display easels having additional panels attached to a top side thereof is desired, as shown in FIGS. 9-10, horizontal tabs 304 and vertical tabs 306 will be cut in the traveling web at a location about 90 degrees relative to the direction of web travel (as shown by arrow A) such that side edge 308 of elongated strip 302 defines the bottom edge of the finished display easel. When a plurality of final cut display easels having additional panels attached to one or both sides of the finished display easel, horizontal tabs 304 and vertical tabs 306 may be die-cut in the traveling elongated strip 302 about 90 degrees relative to the direction of web travel (as shown by arrow A) such that the finished cut line 310 produced by transverse cutting of elongated strip 302 will define the bottom edge of the finished display easel.

Figure 27:
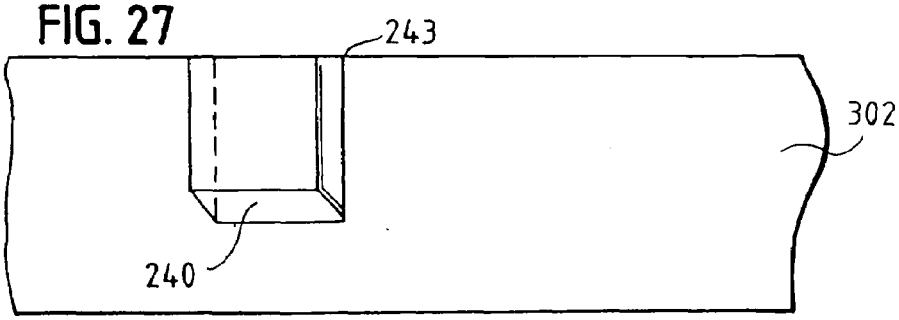
FIG. 27 is a top plan view illustrating the adding of additional panels to an edge of an elongated strip in accordance with the present invention.

Alternatively, additional panels added to elongated strip 302 may be formed from a different source from the web press or alternatively from a different elongated strip. For example, additional panels 240 may be registered then secured to a desired position on elongated strip 302, such as edge 243, as shown in FIG. 27. Additional panels 240 may include coupons, calendar pages, joke pages, menu listings, advertisements, for example, or other any desired printed panel.

In the embodiments discussed above, the additional panels may be of substantially the same size and shape as, or different in size and shape from the formed panels or panels to be formed by the method of the present invention. Moreover, the additional panels may be attached to the elongated strip at any desirable point in the method and by any suitable method and equipment known in the art, which may include using permanent adhesives, using pressure-sensitive adhesives, or providing for removal (detachable panels) of the panels without tearing of the paper fiber. If folding the elongated strip, it is understood that additional panels to be added to the elongated strip should remain on an outer portion of the fold, and therefore, should be attached to the traveling elongated strip at a location such that the additional panels are not folded over.

Figure 28A:
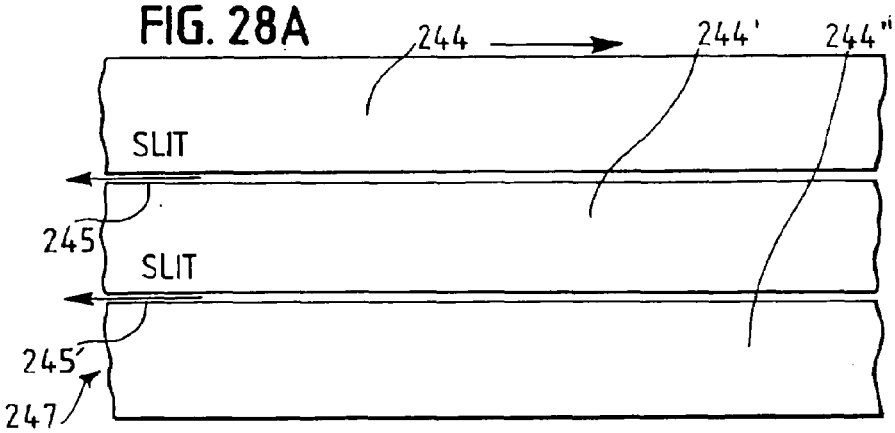
FIG. 28A is a top plan view illustrating longitudinally slitting an elongated strip into a plurality of individual ribbons in accordance with the present invention.

It is contemplated that the method of the present invention may be performed on an elongated web that is not divided into a plurality of ribbons as well as one which is longitudinally slit into a plurality of ribbons. When longitudinally splitting an elongated strip 190 into a plurality of ribbons traveling in the same parallel direction, such as the three ribbons 244, 244', 244" along slit lines 245, 245' of elongated strip 247 as shown in FIG. 28A, the output of display easels using the method of the present invention can be substantially increased. Therefore, after being fed into the web press and prior to or after printing on the elongated strip, the elongated strip may be split into a plurality of different ribbons, wherein each ribbon is capable of having the steps of the present invention performed thereon to form a plurality of display easels according to the present invention.

Figure 28B:
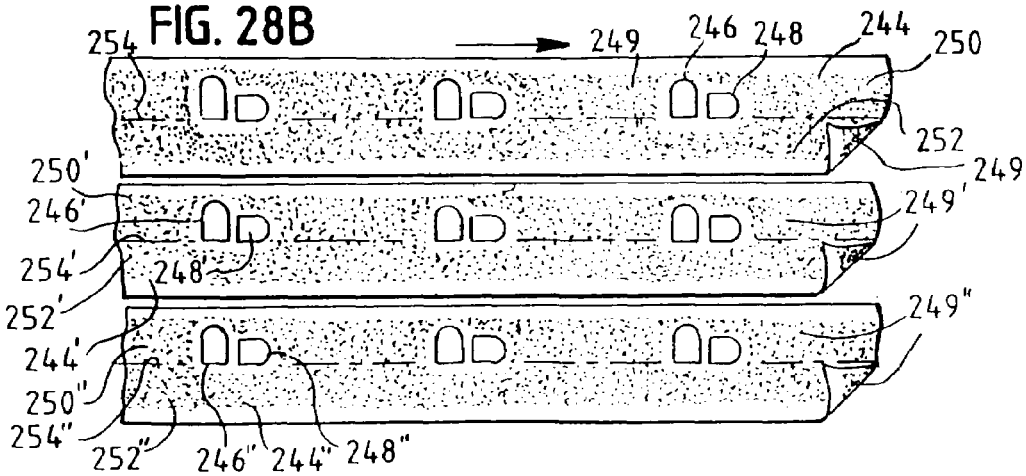
FIG. 28B is a top plan view illustrating the periodic applying of adhesive to a portion of each individual ribbon in accordance with the present invention.
Figure 28C:
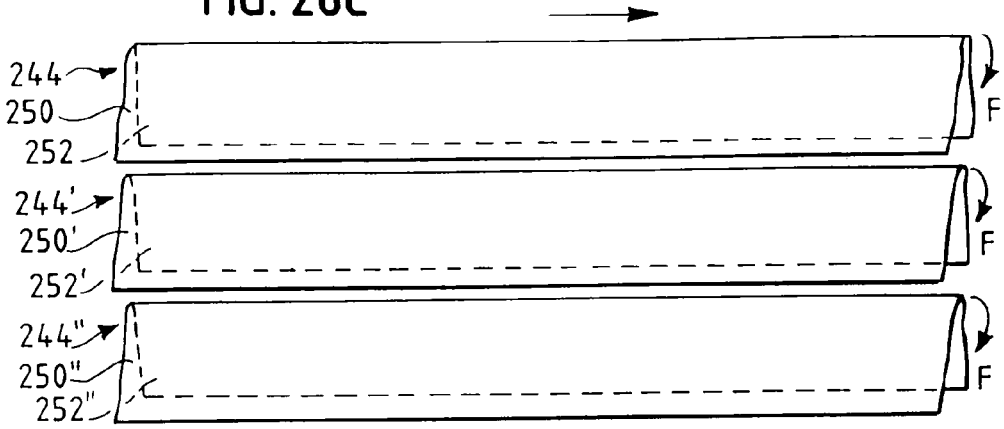
FIG. 28C is a top plan view illustrating the folding of a first longitudinal portion of each ribbon on a second longitudinal portion of each ribbon in accordance with the present invention.
Figure 28D:
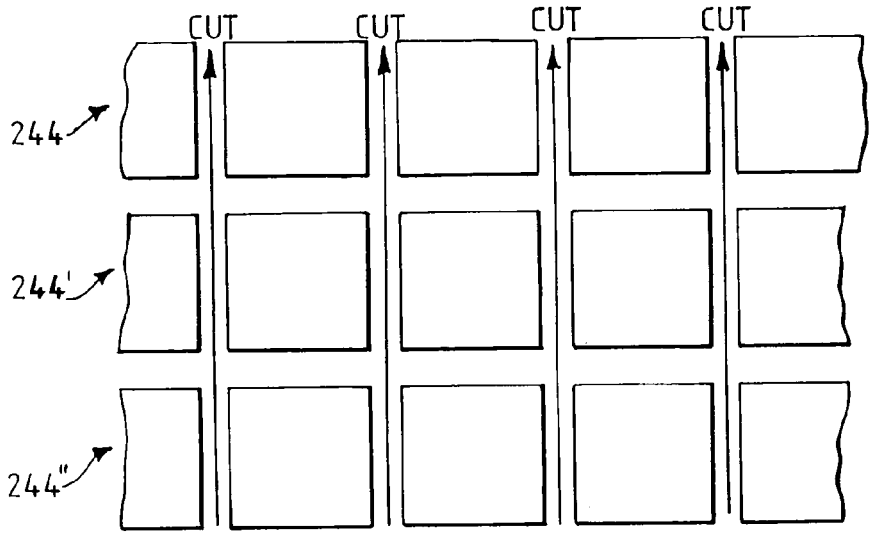
FIG. 28D is a top plan view illustrating the periodic transverse cutting of each ribbon to provide a plurality of individual display easels in accordance with the present invention.

For example, as shown in FIG. 28B, horizontal tabs 246, 246', 246" and vertical tabs 248, 248', 248" are cut into each ribbon 244, 244', 244"on a first longitudinal portion 250, 250', 250" of each ribbon. An adhesive 249, 249', 249" may then be applied to each ribbon 244, 244', 244" to secure first longitudinal portion 250, 250', 250" of each ribbon to a second longitudinal portion 252, 252', 252" of each ribbon, as shown in FIG. 28B. First longitudinal portion 250, 250', 250" of each ribbon may then be folded over the second longitudinal portion 252, 252', 252" of each ribbon at respective foldlines 254, 254', 254" of each ribbon, as shown in FIG. 28C. Each ribbon 244, 244', 244" may then be transversely cut to produce a bulk quantity of display easels. It is contemplated that any method step as described herein as requiring an elongated strip could as well be performed on an individual ribbon of the elongated strip.

Figure 30:
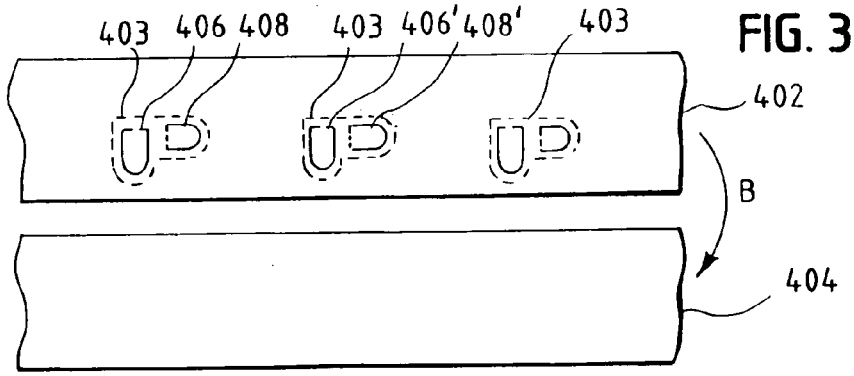
FIG. 30 is a top plan view illustrating the areas of application of adhesive to a first ribbon to be secured to a second ribbon in accordance with the present invention.

In another aspect of the invention, illustrated in FIG. 30, after longitudinally slitting an elongated strip into a plurality of ribbons, a display easel having two attached panels when transversely cut may be formed by applying adhesive to a portion of a first ribbon 402. This can be done, for example, as first ribbon 402 travels through gluing operation 201 and thereafter mating first ribbon 402 to a second ribbon 404 by, for example, overlaying first and second ribbons 402, 404 as shown by arrow B. Ribbon portions 403, which areas contain tabs 406 and 408, are typically free of adhesive so that the adhesive does not interfere with operation of tabs 406 and 408. At least one of ribbons 402, 404 will have horizontal tabs 406, 406' and vertical tabs 408, 408' cut therein. Once mated, ribbons 402, 404 may further be cut and folded in folding operation 203 and final cutting operation 205 as set forth herein to produce a bulk quantity of display easels. Although two mated ribbons are preferred, further ribbons can be mated together as desired to form a multi-layered display easel when the ribbons are mated and subsequently transversely cut.

When splitting the elongated strip into three ribbons and the ribbons travel through the web printing press at 1000 feet per minute, 432,000 individual 5"×5" display easels may be formed an hour.

While the invention has been described with respect to certain preferred embodiments, it is to be understood that the invention is capable of numerous changes, modifications, and rearrangements without departing from the scope or spirit of the invention as defined in the claims.

I claim:

1. A display easel comprising:

a base panel including a front side, a rear side, and a bottom edge;

a horizontal supporting tab disposed substantially parallel to said bottom edge of said base panel on the rear side of said base panel, said supporting tab having a bottom edge which is spaced vertically above and is substantially parallel to said bottom edge of said base panel and a side edge which defines a first hinge for said horizontal supporting tab;

said first hinge enabling movement of the supporting tab relative to the base panel and into a position for supporting the base panel; and a vertical restraining tab spaced vertically from said horizontal supporting tab, wherein a generally horizontal edge of the vertical restraining tab is spaced in vertical relation to the side edge of said horizontal supporting tab, and wherein said generally horizontal edge of said vertical restraining tab defines a second hinge, said second hinge enabling movement of said vertical restraining tab relative to the panel body to permit abutment of the restraining tab to the horizontal supporting tab to restrain movement of said horizontal supporting tab.

2. The display easel of claim 1 wherein said horizontal supporting tab is movable relative to said base panel by at least about 90 degrees.

3. The display easel of claim 1 wherein said vertical restraining tab is movable relative to said base panel by between about 120 to about 160 degrees.

4. The display easel of claim 1 wherein a generally vertical edge of the vertical restraining tab when deployed relative to the base panel abuts and frictionally engages a face of the horizontal supporting tab such that the vertical restraining tab restrains the supporting tab in a deployed position, the relative positions of the vertical restraining tab and the horizontal supporting tab being variable to adjust the position of the horizontal supporting tab relative to the base panel so as to vary the angle of the display easel with respect to a surface upon which the display easel rests.

5. The display easel of claim 1 wherein the generally horizontal edge of the vertical restraining tab is spaced vertically above the side edge of the horizontal supporting tab.

6. The display easel of claim 1 wherein the generally horizontal edge of the vertical restraining tab is spaced vertically below the side edge of the horizontal supporting tab.

7. The display easel of claim 1 wherein said base panel is composed of a plurality of sheets.

8. The display easel of claim 7 wherein the sheets are laminated together.

9. The display easel of claim 7 wherein the side edge of said horizontal supporting tab and a side edge of the vertical restraining tab are located at approximately a transverse center of the base panel.

10. The display easel of claim 9 wherein the generally horizontal edge of said vertical restraining tab is disposed in perpendicular relation to the side edge of said horizontal supporting tab.

11. The display easel of claim 1 wherein said vertical restraining tab includes a generally vertically disposed restraining slit, said restraining slit adapted to receive said horizontal supporting tab within said restraining slit when said horizontal supporting tab and said vertical restraining tab are deployed from said base panel.

12. The display easel of claim 1 wherein said horizontal supporting tab and vertical restraining tab are formed from said base panel.

13. The display easel of claim 1 wherein said hinge of the supporting tab and the hinge of the vertical restraining tab comprise perforations.

14. The display easel of claim 1 further comprising at least one additional panel attached to said base panel along at least a peripheral portion of said additional panel.

15. The display easel of claim 14 wherein said at least one additional panel is of substantially the same size and shape as the base panel.

16. The display easel of claim 15 wherein said base panel is paper having a thickness of about 0.007 inches.

17. The display easel of claim 14 wherein said at least one additional panel is of a different size and shape as the base panel.

18. The display easel of claim 1 wherein the rear side of said display easel comprises a plurality of spaced apart pairs of a horizontal supporting tab and a vertical restraining tab.

19. The display easel of claim 1 wherein the first panel comprises a plurality of overlying panels.

20. The display easel of claim 1 wherein the easel comprises a front portion having a plurality of spaced apart slits for retaining a separate generally planar member therein.

21. The display easel of claim 1 further comprising a plurality of additional panels attached at a peripheral portion of said base panel.

22. display easel of claim 21 wherein the additional panels comprise a calendar.

23. The display easel of claim 21 wherein the additional pages comprise human readable printed indicia.

* * * * *